US012631355B2

(12) United States Patent
Wang et al.

(10) Patent No.: US 12,631,355 B2
(45) Date of Patent: May 19, 2026

(54) ROOT CAUSE ANALYTICS OF HVAC FAULTS

(71) Applicant: HONEYWELL INTERNATIONAL INC., Morris Plains, NJ (US)

(72) Inventors: Xiaoli Wang, Beijing (CN); Chunfu Li, Beijing (CN)

(73) Assignee: HONEYWELL INTERNATIONAL INC., Charlotte, NC (US)

( * ) Notice: Subject to any disclaimer, the term of this patent is extended or adjusted under 35 U.S.C. 154(b) by 460 days.

(21) Appl. No.: 17/758,616

(22) PCT Filed: Jan. 16, 2020

(86) PCT No.: PCT/CN2020/072388

§ 371 (c)(1),
(2) Date: Jul. 11, 2022

(87) PCT Pub. No.: WO2021/142694

PCT Pub. Date: Jul. 22, 2021

(65) Prior Publication Data

US 2023/0029568 A1 Feb. 2, 2023

(51) Int. Cl.

| | |
|---|---|
| ***F24F 11/38*** | (2018.01) |
| ***F24F 11/52*** | (2018.01) |
| ***F24F 11/64*** | (2018.01) |

(52) U.S. Cl.

CPC ..... *F24F 11/38* (2018.01); *F24F 11/52* (2018.01); *F24F 11/64* (2018.01)

(58) Field of Classification Search

CPC ..... F24F 11/38; F24F 11/52; F24F 11/64
(Continued)

(56) References Cited

U.S. PATENT DOCUMENTS

| | | | | |
|---|---|---|---|---|
| 6,223,544 | B1 | 5/2001 | Seem | |
| 11,237,576 | B2 * | 2/2022 | Noboa | G05D 23/1904 |

(Continued)

FOREIGN PATENT DOCUMENTS

| | | | |
|---|---|---|---|
| CN | 101048626 | A | 10/2007 |
| CN | 101566852 | A | 10/2009 |

(Continued)

OTHER PUBLICATIONS

Extended European Search Report, EP Application No. 20913496.4, European Patent Office, Jan. 3, 2024 (10 pages).

*Primary Examiner* — Catherine T. Rastovski
*Assistant Examiner* — Joshua L Forristall
(74) *Attorney, Agent, or Firm* — Seager, Tufte & Wickhem, LLP

(57) ABSTRACT

A HVAC system and method for determining which fault of a group of faults identifies a likely root cause problem in the system. Some example methods may include a controller identifying the root cause based at least partially on which fault is associated with a HVAC device (e.g., boiler, chiller, VAV valve, etc.) that is farthest upstream along a shared fluid flow path or fluid flow network of the HV AC system. In some examples, the shared fluid flow path or network may be defined in a HVAC model representing the HVAC system. The controller may store the HVAC model and reference it when analyzing a group of faults. The controller may limit the inclusion of faults in a group for analysis to only those faults that occur within a certain period of time of each other.

19 Claims, 15 Drawing Sheets

(58) Field of Classification Search
USPC ..... 702/185
See application file for complete search history.

(56) References Cited

U.S. PATENT DOCUMENTS

| | | | | |
|---|---|---|---|---|
| 2009/0271062 | A1 | 10/2009 | Green | |
| 2011/0093424 | A1 | 4/2011 | Zimmermann et al. | |
| 2013/0197698 | A1 | 8/2013 | Shah et al. | |
| 2014/0142727 | A1 | 5/2014 | Giering et al. | |
| 2018/0195749 | A1* | 7/2018 | Sinha | F24F 11/30 |
| 2018/0299155 | A1 | 10/2018 | Walsh et al. | |
| 2019/0034309 | A1* | 1/2019 | Nayak | F24F 11/64 |
| 2019/0128547 | A1 | 5/2019 | Li et al. | |
| 2019/0385070 | A1 | 12/2019 | Lee et al. | |
| 2022/0197271 | A1* | 6/2022 | Alt | G05B 17/02 |

FOREIGN PATENT DOCUMENTS

| | | | |
|---|---|---|---|
| CN | 103403463 | A | 11/2013 |
| CN | 105910247 | A | 8/2016 |

* cited by examiner

ROOT CAUSE ANALYTICS OF HVAC FAULTS

TECHNICAL FIELD

The disclosure relates generally to HVAC systems and more particularly to HVAC controllers for analyzing faults of HVAC systems.

BACKGROUND

HVAC systems (Heating, Ventilating, Air Conditioning systems) typically include various HVAC devices for heating, cooling or otherwise conditioning the air of a comfort zone (e.g., a room or other area within a building). Some example HVAC devices include chillers, boilers, AHUs (air handling units), FCUs (fan coil units), VAV valves (Variable Air Volume valves), heat exchangers, dampers, airducts, etc.

Some type of controller is used for controlling the HVAC system in response to user input and feedback from various sensors associated with the HVAC devices. The sensors typically monitor system variables such as temperature, pressure, flow rate, electrical current, valve position, and efficiency.

If a sensor provides a feedback signal indicating a variable is beyond a predetermined allowable range, conventional controllers will interpret such feedback as a fault or abnormality of the HVAC device most closely associated with the sensor. If multiple faults are active simultaneously, a user or operator of the HVAC system must typically assesses the various alarms to determine a corrective action. This can be tedious, error prone and time consuming.

SUMMARY

The present disclosure pertains to HVAC systems with methods and systems for analyzing incoming alarm data to more quickly identify a likely root cause problem within the system, particularly when the root cause problem happens to trigger multiple sensors on several devices of the system. In some examples, the alarm data may be grouped and organized as a list of faults. In some cases, each fault is paired with a tuple that identifies 1) an HVAC device associated with the fault, 2) a fluid flow path associated with the fault, and 3) a timestamp of when the fault occurred. When multiple faults occur, a controller may display a list of faults that occurred within a certain period of each other and share a common fluid flow path. To identify the likely root cause, the controller then identifies which HVAC device experiencing a fault is farthest upstream along the common fluid flow path.

In some examples of the disclosure, a sensor can be associated with multiple fluid flow paths depending on the operating mode of the HVAC system. For instance, in some examples, a temperature sensor associated with a heat exchanger of an AHU can be on one fluid flow path from a boiler during a heating mode and on a different fluid flow path from a chiller during a cooling mode. Also, some HVAC systems have multiple chillers and multiple boilers, so a particular sensor can be associated with one chiller during one mode of operation and a different chiller during another mode.

In some examples of the disclosure, a fluid flow path might actually be a segmented flow path comprising multiple discrete fluid flow paths interconnected by heat exchangers. A heat exchanger prevents intermixing of the individual fluid flow paths yet connects them thermodynamically in heat transfer relationship.

The preceding summary is provided to facilitate an understanding of some of the features of the present disclosure and is not intended to be a full description. A full appreciation of the disclosure can be gained by taking the entire specification, claims, drawings and abstract as a whole.

BRIEF DESCRIPTION OF THE DRAWINGS

The disclosure may be more completely understood in consideration of the following description of various illustrative embodiments of the disclosure in connection with the accompanying drawings in which.

Figure 1:
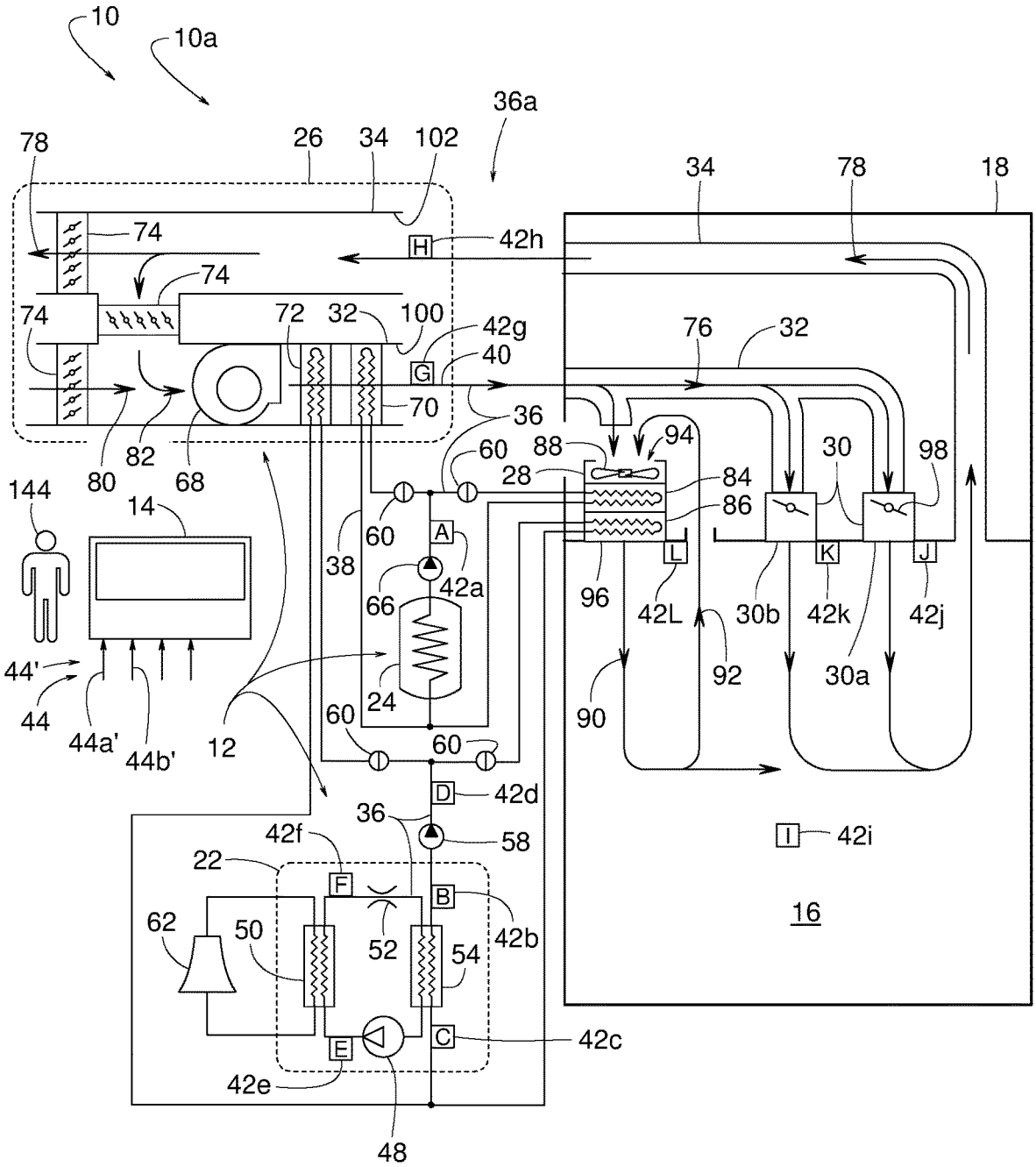
FIG. 1 is a schematic view of an example HVAC system.

While the disclosure is amendable to various modifications and alternative forms, specifics thereof have been shown by way of example in the drawings and will be described in detail. It should be understood, however, that the intention is not to limit the disclosure to the particular illustrative embodiments described herein. On the contrary, the intention is to cover all modifications, equivalents, and alternatives falling within the spirit and scope of the disclosure.

DESCRIPTION

The following description should be read with reference to the drawings wherein like reference numerals indicate like elements throughout the several views. The description and drawings show several examples that are meant to be illustrative of the disclosure.

In some examples, the disclosure pertains to an HVAC system 10 (e.g., HVAC systems 10*a-e*) with a controller for analyzing incoming alarm data to quickly identify a likely root cause problem with the system in cases where the problem triggers multiple sensors on at least one of system's HVAC devices. The term, "HVAC device" refers to any apparatus used for heating, ventilating, cooling, filtering, humidifying, dehumidifying, blowing, compressing, regulating, and/or conveying air.

The term, "HVAC system" refers to any apparatus that includes a plurality of HVAC devices and their controller. The term, "controller" refers to any electronic device (e.g., a computer, a programmable logic controller, etc.) for controlling and/or monitoring HVAC devices and for analyzing a plurality of faults produced or experienced by those devices.

FIGS. 1-6 show an example HVAC system 10*a* including a plurality of HVAC devices 12 and an example controller 14. Some example operating modes of HVAC system 10 include heating, cooling, or otherwise conditioning the air in a comfort zone 16 (e.g., a room, area or space within a building 18). FIG. 7 is an HVAC model 20*a*, in a block diagram format, representing the schematic diagrams shown in FIGS. 1-6. In the illustrated example, some example HVAC devices 12 of system 10*a* include a chiller 22, a boiler 24, an AHU 26 (air handling unit), a FCU 28 (fan control unit), a first VAV valve 30*a* (variable air volume valve), a second VAV valve 30*b*, a supply airduct 32, and a return airduct 34.

A fluid flow network 36 interconnects the HVAC system's various example HVAC devices 12 in thermodynamic communication with each other. Some examples of fluid flow network 36 include fluid flow network 36*a* (FIGS. 1-6), fluid flow network 36*b* (FIG. 9), fluid flow network 36*c* (FIG. 12), fluid flow network 36*d* (FIG. 14) and fluid flow network 36*e* (FIG. 15). The term, "thermodynamic communication" refers to at least two fluid-conveying members that convey or transfer fluid between each other and/or transfer heat between each other. The terms, "fluid communication" and "heat transfer relationship" are two examples of thermodynamic communication. The term, "fluid conveying member" refers to any structure through which a fluid flows. Some example fluid conveying members include an HVAC device, a heat exchanger, a sheet metal housing, a plenum, and a conduit (e.g., a pipe, a tube, and airduct, etc.).

The term, "fluid flow network" refers to at least one path along which at least one fluid travels. Some fluid flow network examples include a single fluid flow path, various arrangements of a plurality of fluid paths (also referred to as a plurality of branches), a plurality of fluids paths or branches along which a plurality of fluids flow, one or more closed loop circulating fluid paths (e.g., a first flow circuit 38 and a second flow circuit 40), a plurality of fluid paths in parallel flow relationship (e.g., a first branch in parallel flow relationship with a second branch), a plurality of fluid paths in series flow relationship (e.g., a first branch in series flow relationship with a second branch), a plurality of non-intermixing fluid paths connected in heat transfer relationship, and various combinations thereof. Some more specific examples include water flowing through a pipe, gas flowing through a valve, air flowing through a comfort zone, air flowing through an airduct, refrigerant flowing through a tube, air flowing through a blower, a liquid and air flowing in heat transfer relationship through a heat exchanger, and various combinations thereof.

Figure 5:
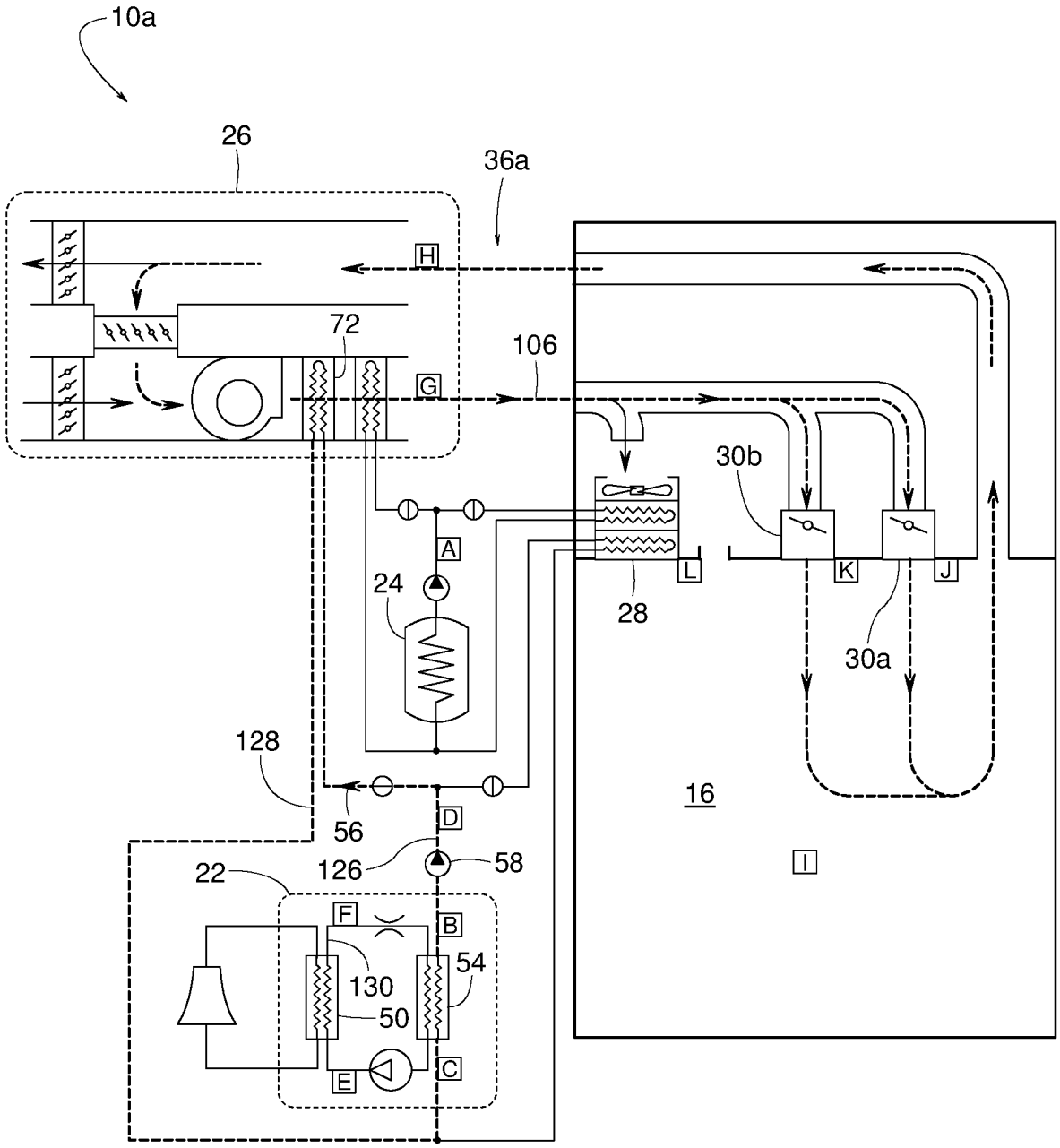
FIG. 5 is a schematic view showing a fourth example operating mode of the HVAC system shown in FIG. 1.

Chiller 22 is schematically illustrated to represent any refrigerant charged HVAC device for providing a supply of cooled liquid (water, glycol, mixtures thereof, etc.). In some examples, chiller 22 includes a compressor 48, a condenser 50, an expansion device 52, and an evaporator 54 connected in a closed loop refrigerant circuit to generate chilled water 56 (FIG. 5). A pump 58 delivers water 56 to AHU 26 and/or to FCU 28, depending which of valves 60 are open or closed. In some examples, a cooling tower 62 removes heat from condenser 50.

Boiler 24 is schematically illustrated to represent any HVAC device for providing a supply of heated fluid 64 (e.g., water, steam, etc.). A pump 66 forces fluid 64 through boiler 24 and then onto AHU 26 and/or FCU 28, depending on which of valves 60 are open or closed.

The illustrative AHU 26 is schematically illustrated to represent any HVAC device that includes a blower 68, at least one heat exchanger (e.g., a heat exchanger 70 for heating and/or a heat exchanger 72 for cooling). The illustrative AHU 26 includes dampers 74 and provides conditioned supply air 76 to comfort zone 16 and in some cases, may exchange some used indoor return air 78 with fresh outside air 80. In the illustrated example, chiller 22 feeds heat exchanger 72, and boiler 24 feeds heat exchanger 70, while blower 68 forces a mixture of return air 82 and fresh air 80 through heat exchangers 70 and 72 to deliver conditioned supply air 76 to VAV valve 30*a*, VAV valve 30*b*, and FCU 28.

FCU 28 is schematically illustrated to represent any HVAC device that includes at least one heat exchanger (e.g., a heat exchanger 84 for heating and/or a heat exchanger 86 for cooling) and a blower 88 for circulating temperature conditioned air 90 through comfort zone 16. In the illustrated example, heat exchanger 86 is cooled by way of chilled water 56 (FIG. 6) from chiller 22. In other examples, FCU 28 may itself include a refrigerant circuit with heat exchanger 86 serving as the refrigerant circuit's evaporator for more direct cooling. In either case, in the example shown, blower 88 forces a mixture of supply air 76 and room air 92 through an inlet 94 of FCU 28, through heat exchangers 84 and 86, and out through an outlet 96 of FCU 28.

VAV valves 30 are schematically illustrated to represent any HVAC device for adjusting the amount of air flowing through them. In some examples, controller 14 regulates the amount of airflow by adjusting the position of a movable element 98 (e.g., flap, damper, valve plug, etc.) of each VAV valve 30.

HVAC system 10 also includes various sensors 42 (e.g., sensors 42*a*, 42*b*, 42*c*, 42*d*, 42*e*, 42*f*, 42*g*, 42*h*, 42*i*, 42*j*, 42*k*, 42L). Sensors 42 are each schematically illustrated to represent any type of transducer for generating a feedback signal 44 in response to a monitored variable associated with an HVAC device 12. Some examples of sensors 42 include a pressure sensor, a temperature sensor, an electrical current sensor, an airflow sensor, a humidity sensor, and combinations thereof (e.g., a combination to monitor efficiency).

In the illustrated example, sensor 42*a* is associated with boiler 24, sensors 42*b*, 42*c*, 42*d*, 42*e*, and 42*f* are associated with chiller 22, sensors 42*g* and 42*h* are associated with AHU 26, sensor 42*i* is associated with comfort zone 16, sensor 42*j* is associated with first VAV valve 30*a*, sensor 42*k* is associated with second VAV valve 30*b*, and sensor 42L is associated with FCU 28.

When sensor feedback signals 44 go beyond a predetermined allowable range, such signals are referred to as fault signals 44'. Fault signals 44' are usually the result of one or more HVAC devices 12 (e.g., chiller 22, boiler 24, AHU 26, FCU 28, VAV valves 30, etc.) producing or experiencing a fault 46 (e.g., an abnormal condition exceeding a predetermined allowable range).

Figure 8:
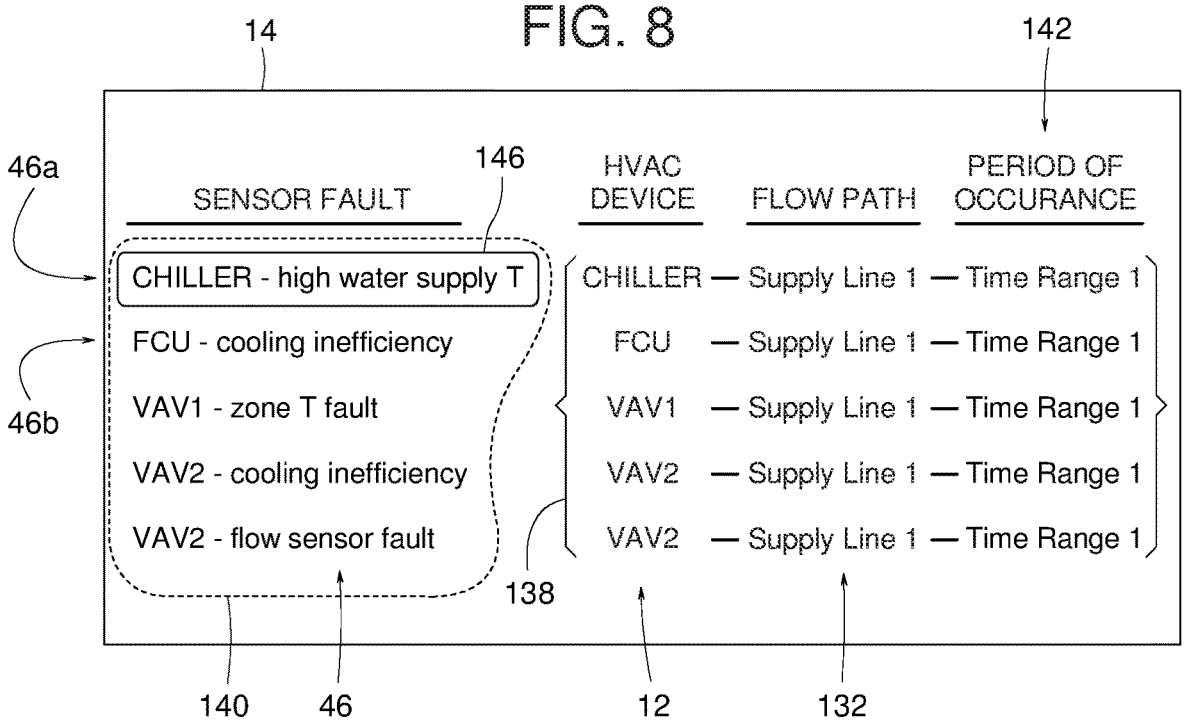
FIG. 8 is a chart showing how at least portions of the HVAC model of FIG. 7 can be represented in a data list format.
Figure 11:
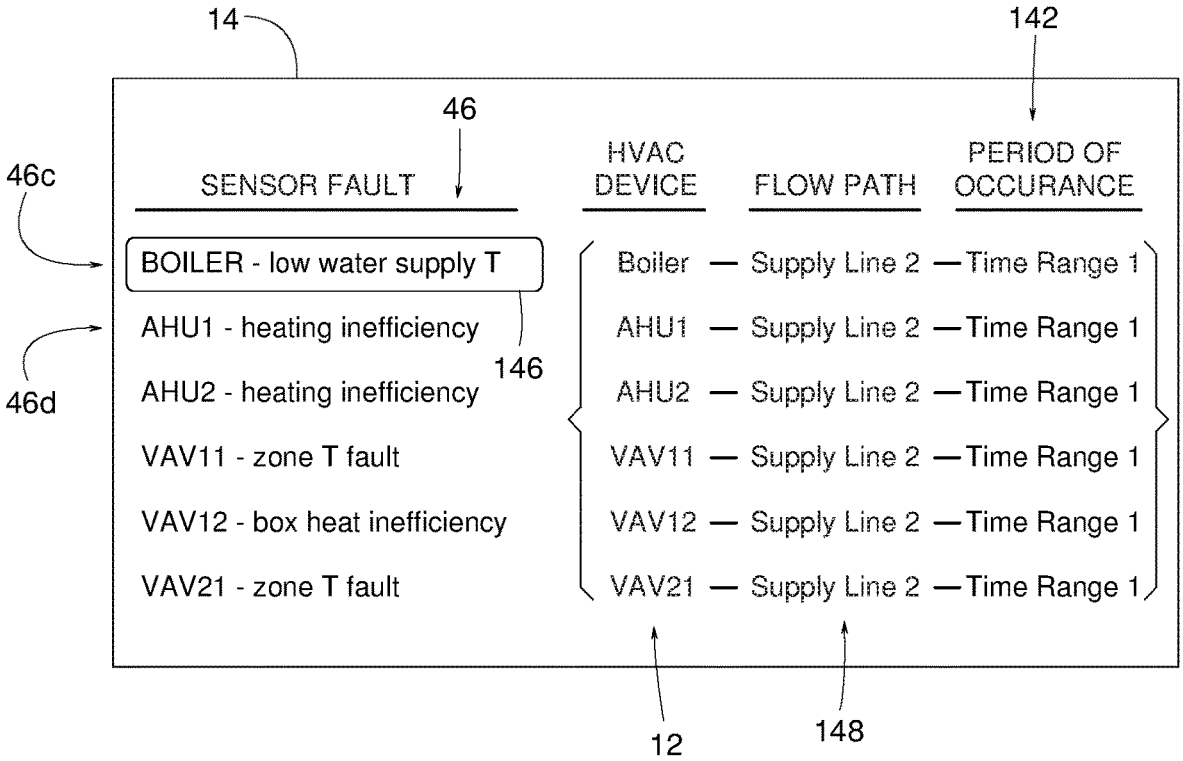
FIG. 11 is a chart showing how at least portions of the HVAC model of FIG. 10 can be represented in a data list format.

In some situations, sensors 42 provide controller 14 with a plurality of fault signals 44' in response to one or more HVAC devices 12 producing or experiencing a plurality of faults 46 (FIGS. 8 and 11). In some examples, controller 14 analyzes the multiple fault signals 44' (e.g., a first fault signal 44*a*', a second fault signal 44*b*', etc.) to determine which one likely identifies a root cause problem.

Sometimes a first fault at one HVAC device 12 along fluid flow network 36 is caused by a second fault occurring at an upstream HVAC device. It should be noted that the terms, "first fault" and "second fault" are simply nondescript names to distinguish one fault from another. The terms, "first fault" and "second fault" do not suggest one fault occurs before the other, nor do those terms imply that one fault causes the other. In some examples, a sensor 42 might detect a fault 46 of an HVAC device 12 at a downstream position along fluid flow network 36 before a different sensor 42 detects a related fault 46 of an HVAC device 12 at an upstream position even though the problem may have originated at the upstream position. This can happen if the downstream sensor is more sensitive or has a tighter allowable range than the upstream sensor. In other examples, of course, the upstream sensor trips before the downstream one does due to the time it might take for the problem to propagate downstream.

In the example of HVAC system 10*a*, shown in FIGS. 1-6, supply airduct 32 conveys conditioned supply air 76 from an outlet 100 of AHU 26 to inlets of FCU 28 and VAV valves 30. Return airduct 34 conveys used air 78 from comfort zone 16 back to an inlet 102 of AHU 26. HVAC system 10*a* has different operating modes depending on the open/closed positions of valves 60 and further depending on the control of the system's various HVAC devices 12.

Figure 2:
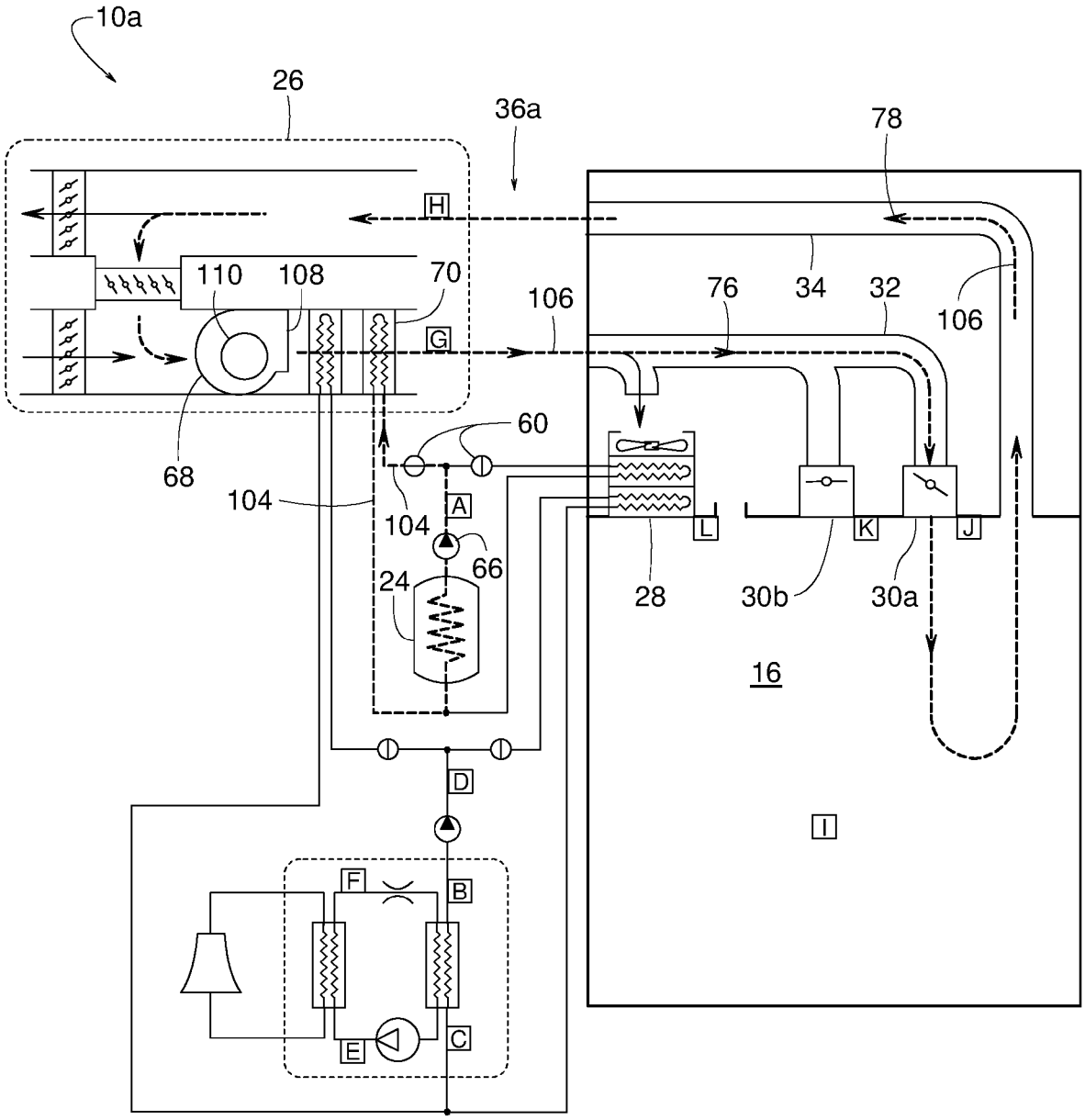
FIG. 2 is a schematic view showing one example operating mode of the HVAC system shown in FIG. 1.

In the example shown in FIG. 2, the open/closed positions of valves 60 are set such that fluid flow network 36*a* includes a first branch 104 circulating hot water 64 to heat exchanger 70 of AHU 26. VAV valve 30*b* is closed while VAV valve 30*a* is open. The open/closed positions of VAV valves 30*a* and 30*b* provide fluid flow network 36*a* with a second branch 106 that conveys air 76/78 flowing from AHU 26, through supply airduct 32, through open VAV valve 30*a*, through comfort zone 16, through return airduct 34, and back to AHU 26. Pump 66 forces hot water 64 through first branch 104, while blower 68 forces air 76/78 through second branch 106.

In some examples of second branch 106, sensor 42*g* (e.g., an air temperature sensor, air pressure sensor, an airflow sensor, etc.) is farthest upstream because it is closest to a discharge outlet 108 of blower 68. Sensor 42*h* (e.g., an air temperature sensor, air pressure sensor, an airflow sensor, etc.) is farthest downstream, as it is closest to the blower's suction inlet 110. Sensor 42*j* (e.g., an air temperature sensor, air pressure sensor, an airflow sensor, valve position limit switch, etc.) is downstream of sensor 42*g*, and sensor 42*i* (e.g., a room thermostat, temperature sensor, humidity sensor, etc.) is downstream of sensor 42*j*. Since first branch 104 is the main thermal source for second branch 106, all points on second branch 106, in some examples, are considered and modeled as being downstream of first branch 104, and so sensor 42*a* (temperature sensor, pressure sensor, flow sensor, etc.) is considered upstream of sensors 42*g*, 42*j*, 42*i* and 42*h*.

Figure 3:
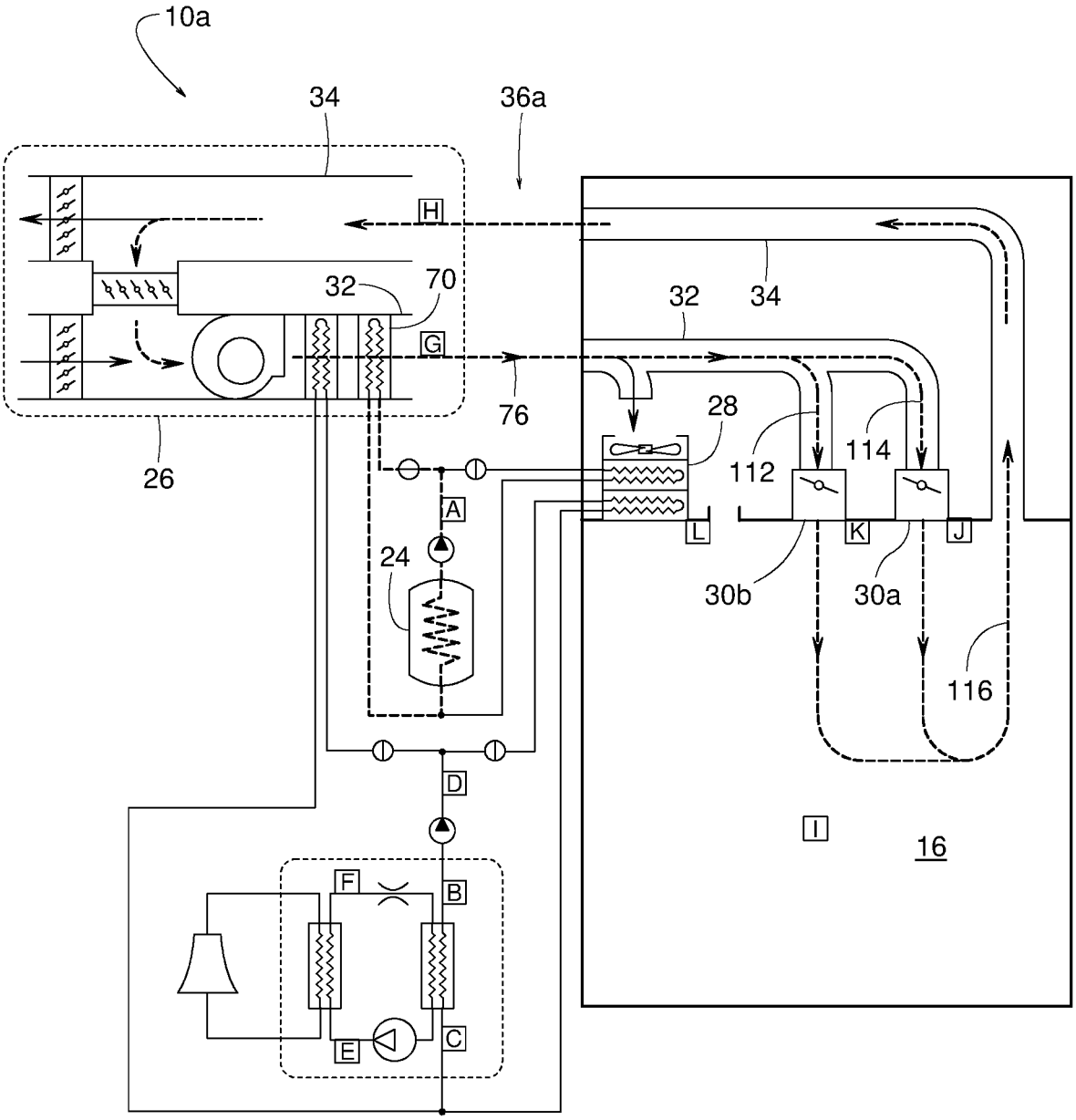
FIG. 3 is a schematic view showing a second example operating mode of the HVAC system shown in FIG. 1.

In FIG. 3, fluid flow network 36*a* provides an example operating mode similar to FIG. 2 but with both VAV valves 30*a* and 30*b* being open. Air 76 flowing through supply airduct 32 of AHU 26 then splits into parallel flow paths 112 and 114 through VAV valves 30*a* and 30*b*. Paths 112 and 114 mix in comfort zone 16 to create a combined path 116, which leads back to AHU 26 via return airduct 34. Some HVAC models consider sensor 42*a* as being farthest upstream, sensor 42*g* as being downstream of sensor 42*a*, sensors 42*j* and 42*k* as being equally downstream of sensor 42*g*, sensor 42*i* as being downstream of sensors 42*j* and 42*k*, and sensor 42*h* as being downstream of sensor 42*i*.

Figure 4:
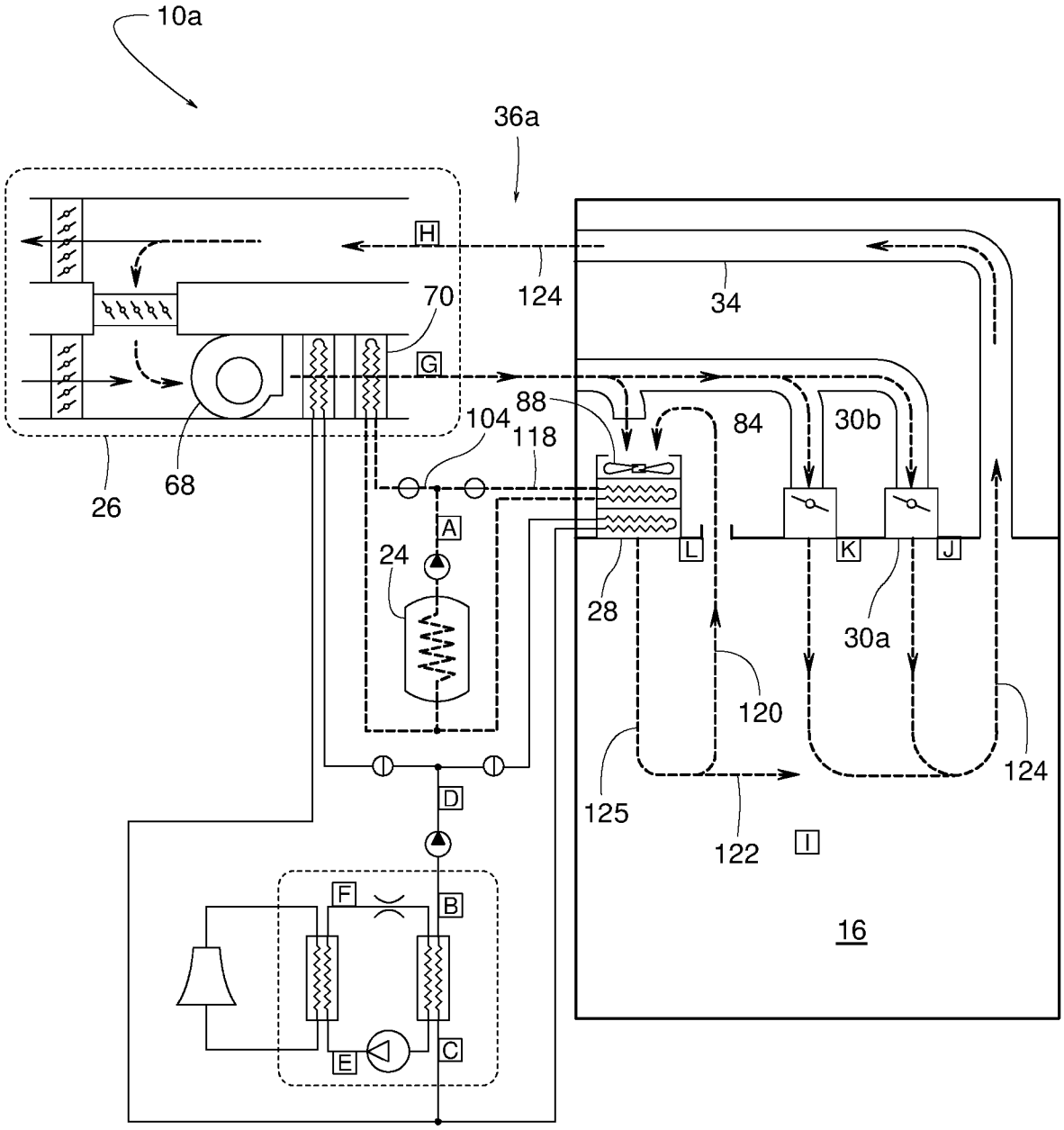
FIG. 4 is a schematic view showing a third example operating mode of the HVAC system shown in FIG. 1.

FIG. 4 shows an example operating mode similar to FIG. 3 with both VAV valves 30*a* and 30*b* open plus the additional use of FCU 28. A branch 118 delivers hot water from boiler 24 to heat exchanger 84 of FCU 28. Blower 88 of FCU 28 creates an air current 125, a portion 120 of which circulates back through FCU 28. The remaining portion 122 of air current 125 mixes with air in comfort zone 16 to create a combined current of air 124 that returns to AHU 26 via return airduct 34.

Some example HVAC models of this arrangement consider sensor 42*a* as being farthest upstream: sensor 42*g* as being downstream of sensor 42*a*: sensors 42*j*, 42*k* and 42L as being equally downstream of sensor 42*g*: sensor 42*i* as being downstream of sensors 42*j* and 42*k*; and sensor 42*h* as being downstream of sensor 42*i*. In this example, sensor 42L (e.g., an air temperature sensor, air pressure sensor, an airflow sensor, electrical current sensor, and various combinations thereof, etc.) is associated with FCU 28. Also, some example HVAC model representations consider sensor 42L of FCU 28 as being downstream of sensor 42*a*.

In FIG. 5, fluid flow network 36*a* provides an example operating mode similar to FIG. 4, but comfort zone 16 is cooled by chiller 22 rather than heated by boiler 24. Some example HVAC models of this arrangement consider sensor 42*d* (e.g., temperature sensor, pressure sensor, flow sensor, etc.) as being farthest upstream, as sensor 42*d* is at discharge outlet 126 of chilled water pump 58. Some example HVAC models consider sensor 42*c* (e.g., temperature sensor, pressure sensor, flow sensor, etc.) as being downstream of sensor 42*d*, sensor 42*b* (e.g., temperature sensor, pressure sensor, flow sensor, etc.) as being downstream of sensor 42*c*, and sensor 42*b* as being the most downstream sensor of a chilled water branch 128, as sensor 42*b* is at the suction inlet of chilled water pump 58. Heat exchanger 72 of AHU 26 plus evaporator 54 and condenser 50, provides fluid flow network 36*a* with a refrigerant branch 130, chilled water branch 128, and a conditioned airflow branch 106. Due to the relative supply-to-branch relationships of the refrigerant, water and air circuits, sensors 42*b*, 42*c*, 42*d*, 42*e*, and 42*f* are each considered as being upstream of any of the sensors in the airflow paths leading to and from AHU 26.

Figure 6:
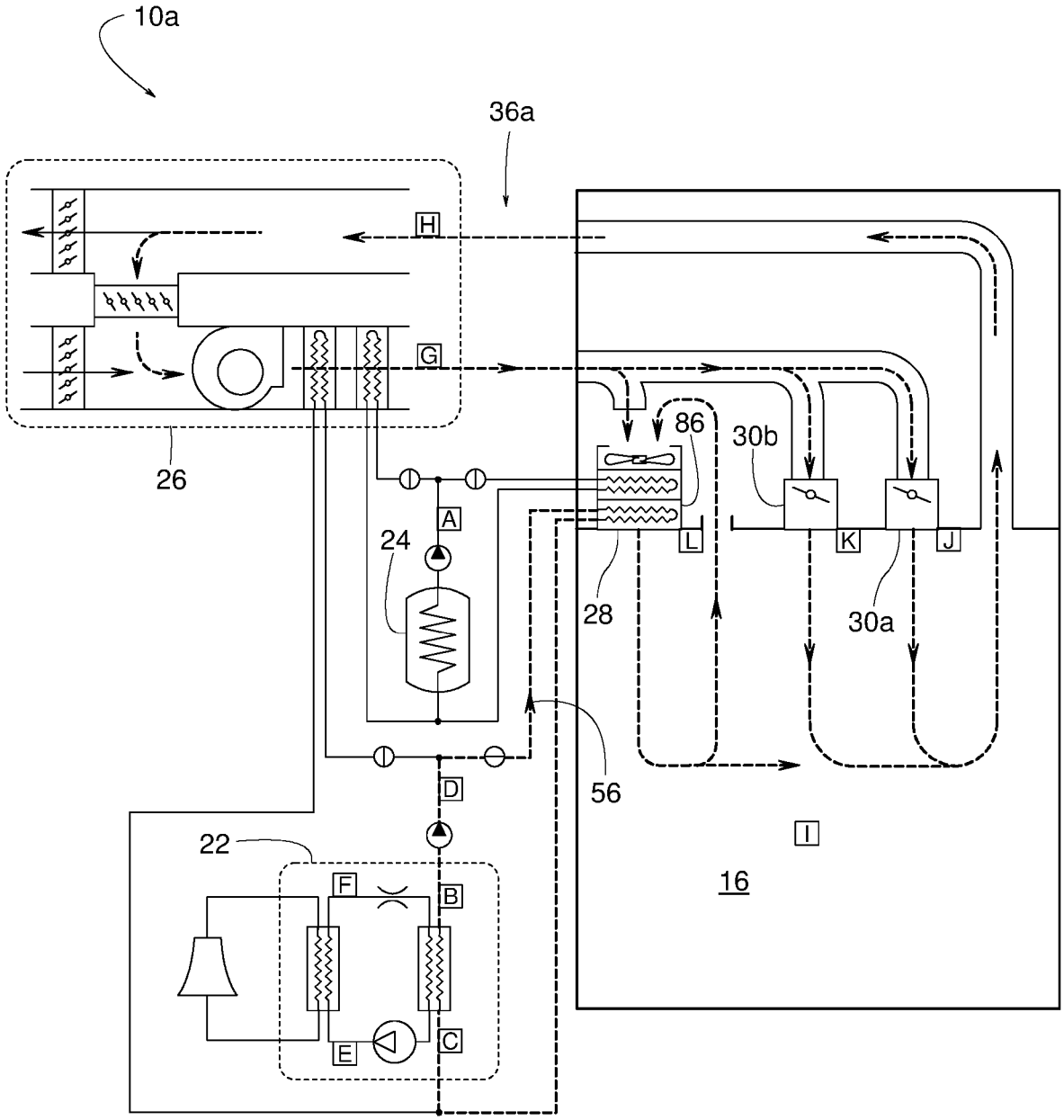
FIG. 6 is a schematic view showing a fifth example operating mode of the HVAC system shown in FIG. 1.
Figure 7:
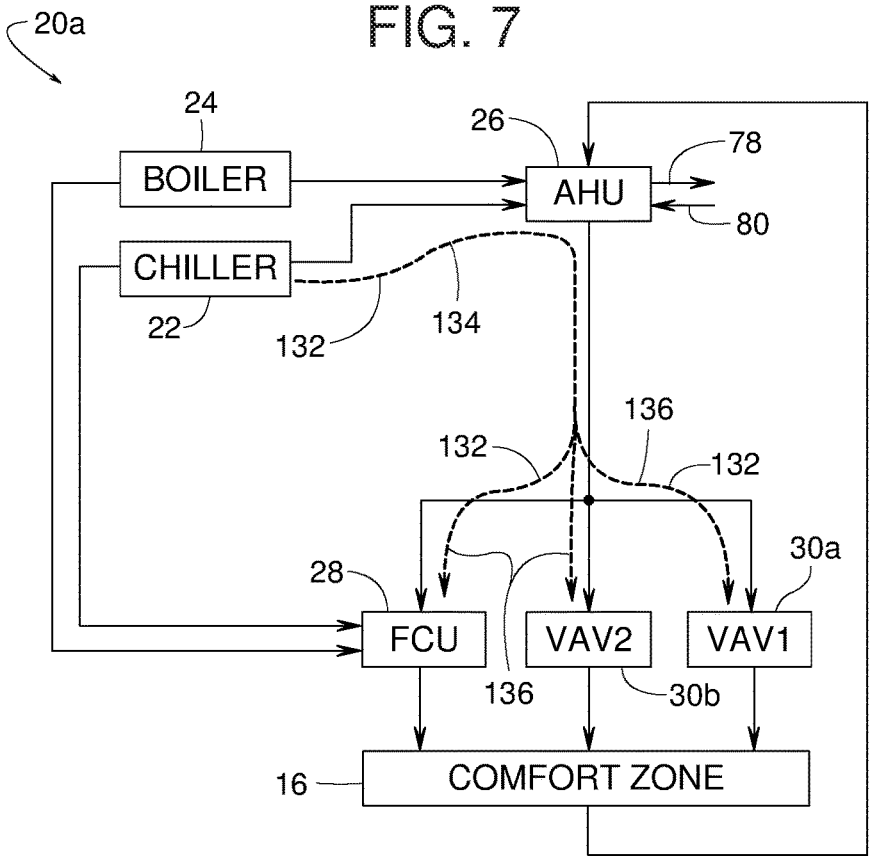
FIG. 7 is a block diagram showing an example HVAC model representing the HVAC system shown in FIGS. 1-6.

In FIG. 6, fluid flow network 36*a* provides an example operating mode similar to FIG. 4 but instead of boiler 24 being used for heating comfort zone 16, chiller 22 is used for cooling comfort zone 16. In the heating mode of FIG. 4, both heat exchanger 70 in AHU 26 and heat exchanger 84 in FCU 28 are employed for heating comfort zone 16. In the cooling mode, shown in FIG. 6, heat exchanger 86 in FCU 28 is employed for cooling, but no heat exchanger in AHU 26 is used.

Selectively activating various fluid flow paths or branches of fluid flow network 36*a* determines the different operating modes of HVAC system 10*a*. In the example of fluid flow network 36*a*, shown in FIGS. 1-6, the relative upstream/downstream positions of boiler 24, chiller 22, AHU 26, FCU 28 and VAV valves 30 can be depicted in an HVAC model 20*a*, as shown in FIG. 7.

HVAC model 20*a* shows that fluid flow network 36*a* has a Supply Line-1 (132) including multiple branches, e.g., a supply branch 134 extending from chiller 22 to a plurality of branches 136 through FCU 28 and VAV valves 30*a* and 30*b*. HVAC model 20*a* shows that, with reference to Supply Line-1 (132), chiller 22 is upstream of AHU 26, which in turn is upstream of FCU 28 and VAV valves 30*a* and 30*b*. Consequently, any sensors 42 of those HVAC devices would have the same relative upstream/downstream positions.

In addition or alternatively, the relative upstream/downstream positions of HVAC devices 12 can be represented as an HVAC model in a data list format (e.g., tuple data 138), such as shown in FIG. 8. Regardless of the HVAC model format (FIG. 7 or 8), at least some representation of HVAC model 20*a* is stored in controller 14. Controller 14 may reference HVAC model 20*a* in determining which of a plurality of faults 46 identifies or represented the most likely root cause problem.

In some examples, controller 14 achieves this by grouping multiple occurring faults 46 (e.g., a first fault 46*a*, a second fault 46*b*, etc.) of HVAC devices 12 that share a common flow path, e.g., Supply Line-1 (132) and then arranging the grouped faults 46 in order of their upstream/downstream relationship along the common fluid flow path.

In some examples, controller 14 does the sorting and analyzing of the data. Controller 14, in some examples, determines a likely root cause problem based at least partially on the fault signal of an HVAC device 12 that is most upstream along the common flow path. In some examples, controller 14 displays all of the faults 46 in a group 140 for the purpose of human evaluation and then marks, emphasizes, highlights or otherwise draws a user's attention to the fault most likely at the source of the root cause problem.

For instance, in the example shown in FIG. 8, if chiller 22, FCU 28, and VAV valves 30*a* and 30*b* each produce at least one fault 46 within a certain period of occurrence 142 (e.g., within 90 minutes of each other), and each share a commonly linked flow path (e.g., Supply Line-1 (132), a single flow path, one or more thermodynamically interconnected circulating flow paths, one or more thermodynamically interconnected supply paths, one or more thermodynamically interconnected branch paths, and various combinations thereof), controller 14 identifies and displays which of HVAC devices 12 is farthest upstream along fluid flow network 36*a*. In this example, chiller 22 is the HVAC device that is at the farthest upstream/downstream position along Supply Line-1 (132), so controller 14 provides an operator 144 (i.e., a person at controller 14, as shown in FIG. 1) with an indication 146 to address the fault identified as, "CHILLER-high water supply T," rather than directing operator 144 to address other faults at more downstream positions.

The term, "indication" refers to any visual means that marks, emphasizes, highlights or otherwise draws an operator's attention to which of fault signals 44' is most likely at the source of the root cause problem. In the example shown in FIG. 8, indication 146 is a box encircling, "CHILLER-high water supply T." This suggests to operator 144 that the chiller's high water supply temperature is a root cause problem that led to the other faults shown in group 140 illustrated in FIG. 8. In some cases, to reduce the number of faults that are presented to the operator, only the fault in the group that is identified as corresponding to the root cause problem is presented to the operator. The remaining faults in the group may not be initially presented to the user.

Figure 9:
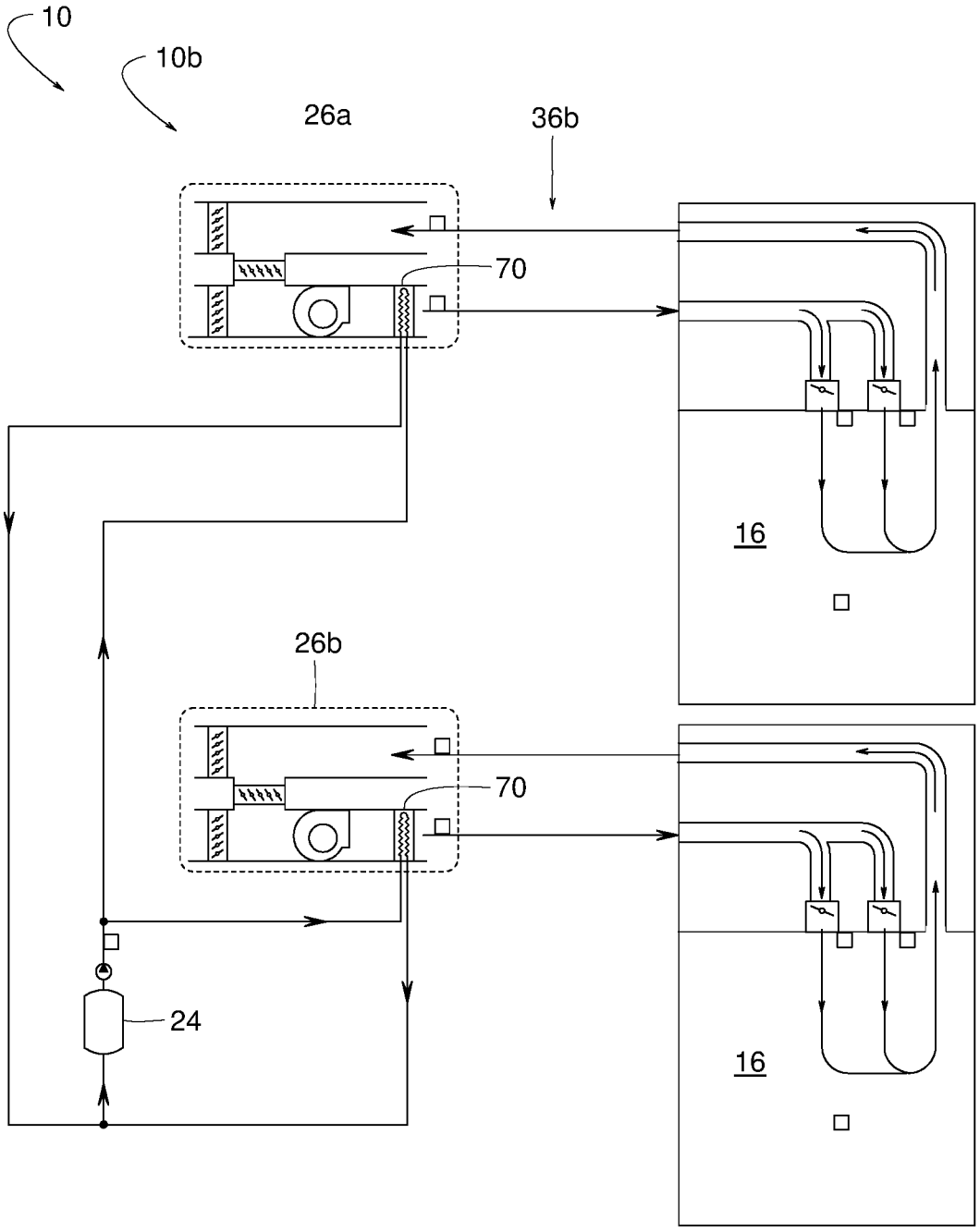
FIG. 9 is a schematic view of a second example HVAC system.
Figure 10:
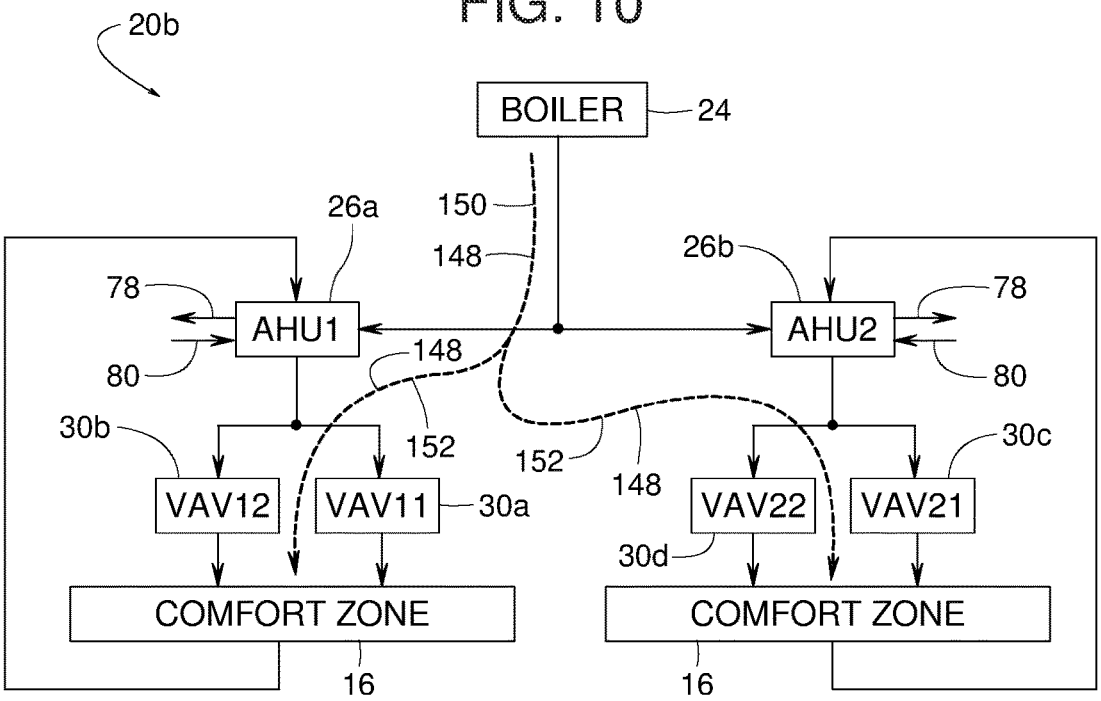
FIG. 10 is a block diagram showing an example HVAC model representing the HVAC system shown in FIG. 9.

FIGS. 9 and 10 show an example of how a fluid flow network 36*b* can connect a boiler 24; two AHUs 26, e.g., AHU1 (26*a*) and AHU2 (26*b*); and multiple VAV valves 30, e.g., VAV11 (30*a*), VAV12 (30*b*), VAV21 (30*c*) and VAV22 (30*d*) to heat the air of two comfort zones 16.

In the example of fluid flow network 36*b*, the relative upstream/downstream positions of boiler 24, the two AHUs 26, and the four VAV valves 30 are depicted in an HVAC model 20*b* shown in FIG. 10 and/or in FIG. 11. HVAC model 20*b* shows that fluid flow network 36*b* has a Supply Line-2 (148) shared by each of the two AHUs 26 and the four VAV valves 30. Supply Line-2 (148) includes a plurality of branches including a supply branch 150 extending from boiler 24 and multiple downstream branches 152 extending from supply branch 150. Downstream branches 152 pass through the two AHUs 26 and the four VAV valves 30.

With reference to Supply Line-2 (148), HVAC model 20*b* shows that boiler 24 is upstream of both AHUs 26, which in turn are upstream of the four VAV valves 30. Consequently, any sensors 42 of those HVAC devices would have the same relative upstream/downstream positions.

In the illustrated example, shown in FIGS. 9-11, if boiler 24, AHU1 (26*a*), AHU2 (26*b*), VAV11 (30*a*), VAV12 (30*b*), and VAV21 (30*d*) each produce at least one fault 46 within a certain period of occurrence 142, and each share the same combined flow path (e.g., Supply Line-2), controller 14 identifies and displays which of HVAC devices 12 is farthest upstream along fluid flow network 36*b*. In this example, boiler 24 is the HVAC device that is at the farthest upstream/downstream position along Supply Line-2 (148), so controller 14 provides operator 144 with indication 146 to address the fault identified as, "BOILER-low water supply T," rather than directing operator 144 to address other faults at more downstream positions.

Figure 12:
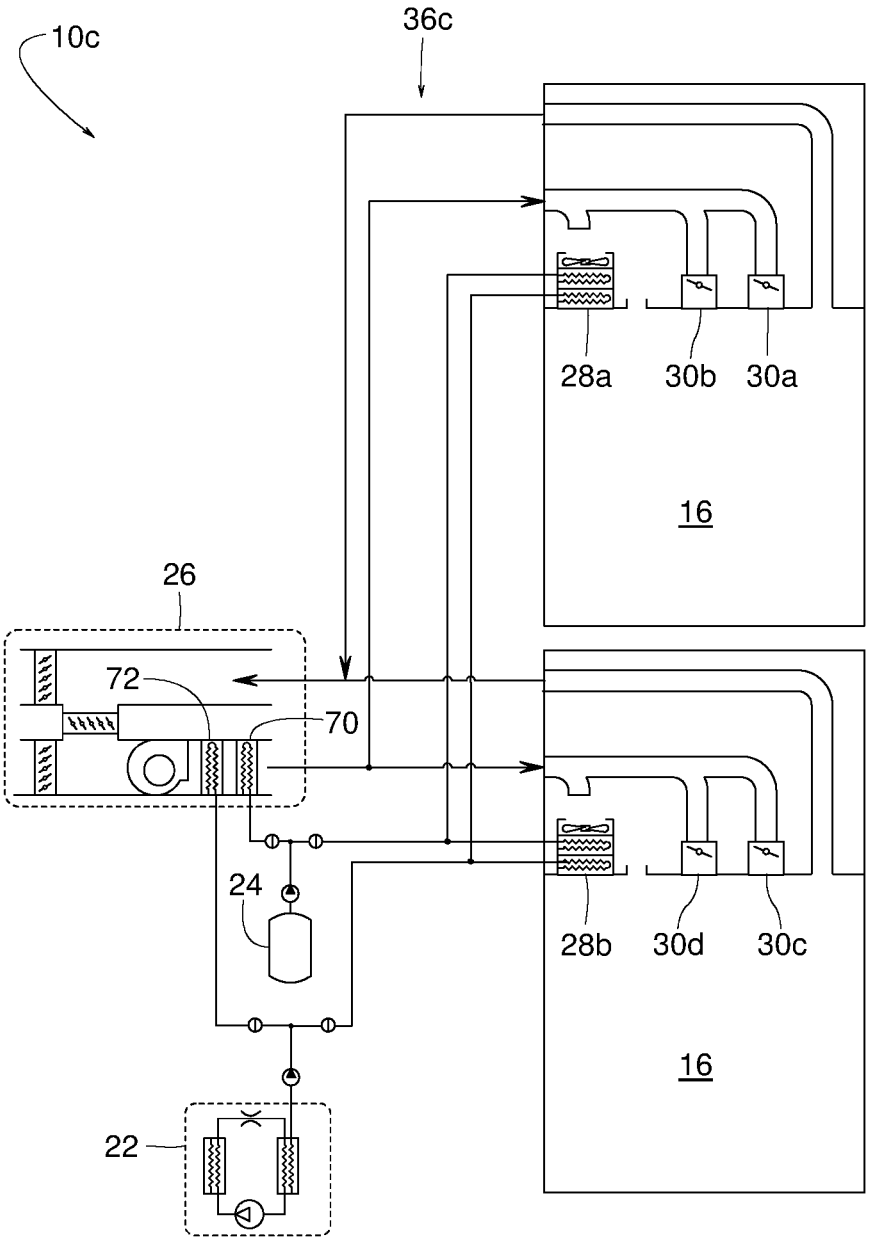
FIG. 12 is a schematic view of a third example HVAC system.
Figure 13:
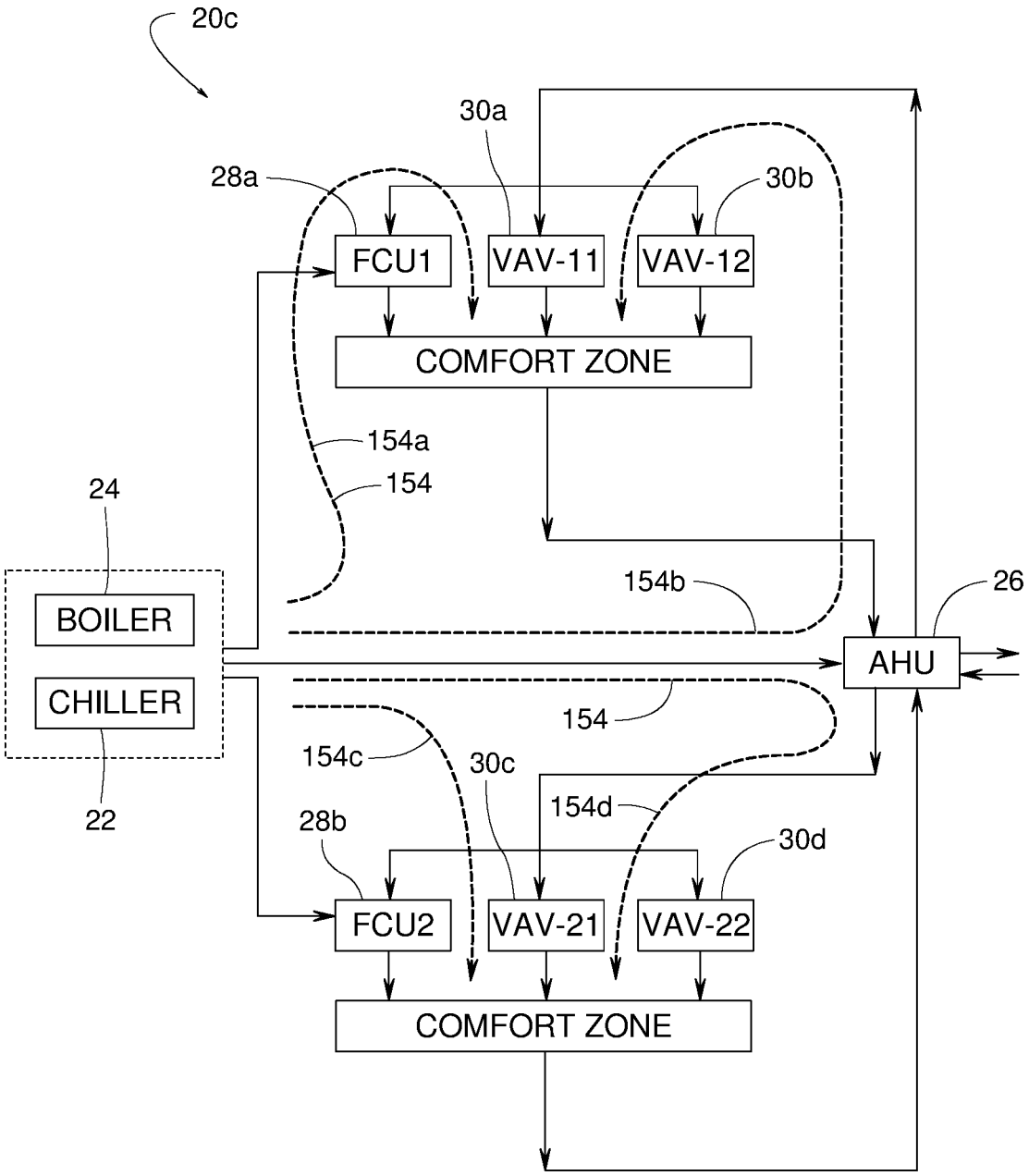
FIG. 13 is a block diagram showing an example HVAC model representing the HVAC system shown in FIG. 12.

FIGS. 12 and 13 show an example of how a fluid flow network 36*c* can connect boiler 24, chiller 22 and AHU 26 in an arrangement to serve two comfort zones 16. Each comfort zone 16, in this example, is fed conditioned air by a dedicated set of HVAC devices 12, wherein each set includes at least one FCU 28 (e.g., FCU 28*a* and FCU 28*b*) and multiple VAV valves 30 (e.g., VAV valves 30*a*, 30*b*, 30*c* and 30*d*).

This example of fluid flow network 36*c* has multiple supply lines 154 (e.g., supply lines 154*a*, 154*b*, 154*c* and 154*d*) and branches thereof, as indicated by HVAC model 20*c* of FIG. 13. Controller 14 references HVAC model 20*c* to help identify a fault at an HVAC device that is farthest upstream along one of supply lines 154. Similar to the previously described examples, controller 14 then provides an indicator 146 directing operator 144 to a likely root cause problem.

Figure 14:
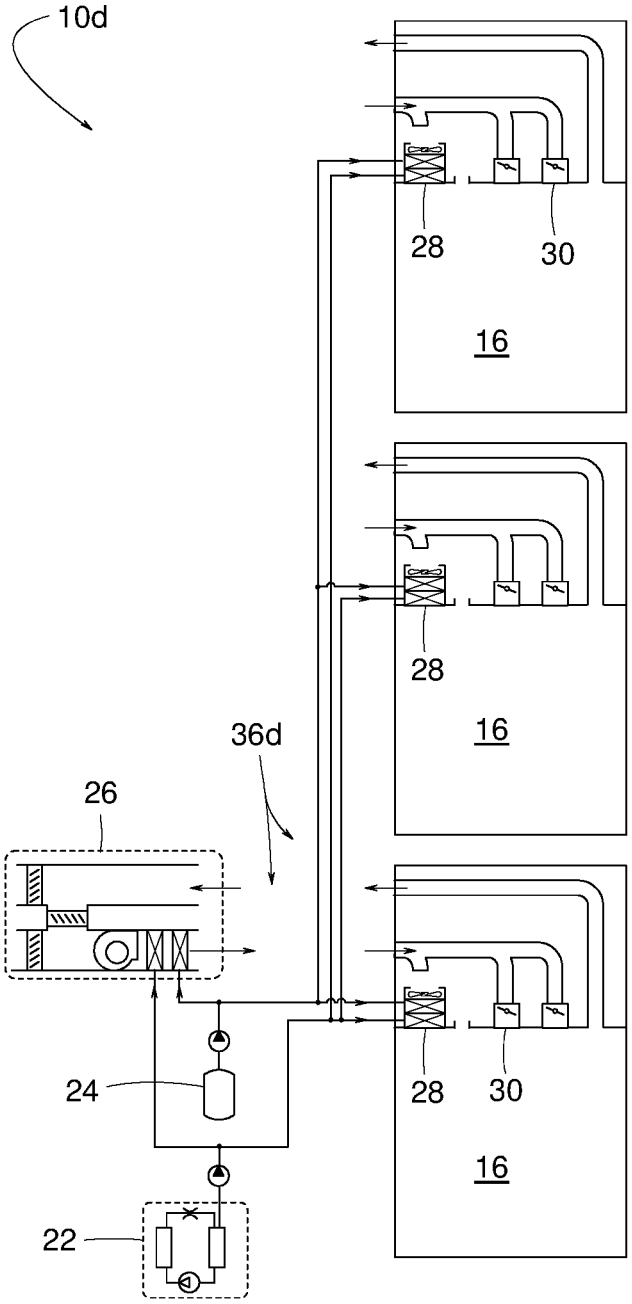
FIG. 14 is a schematic view of a fourth example HVAC system.
Figure 15:
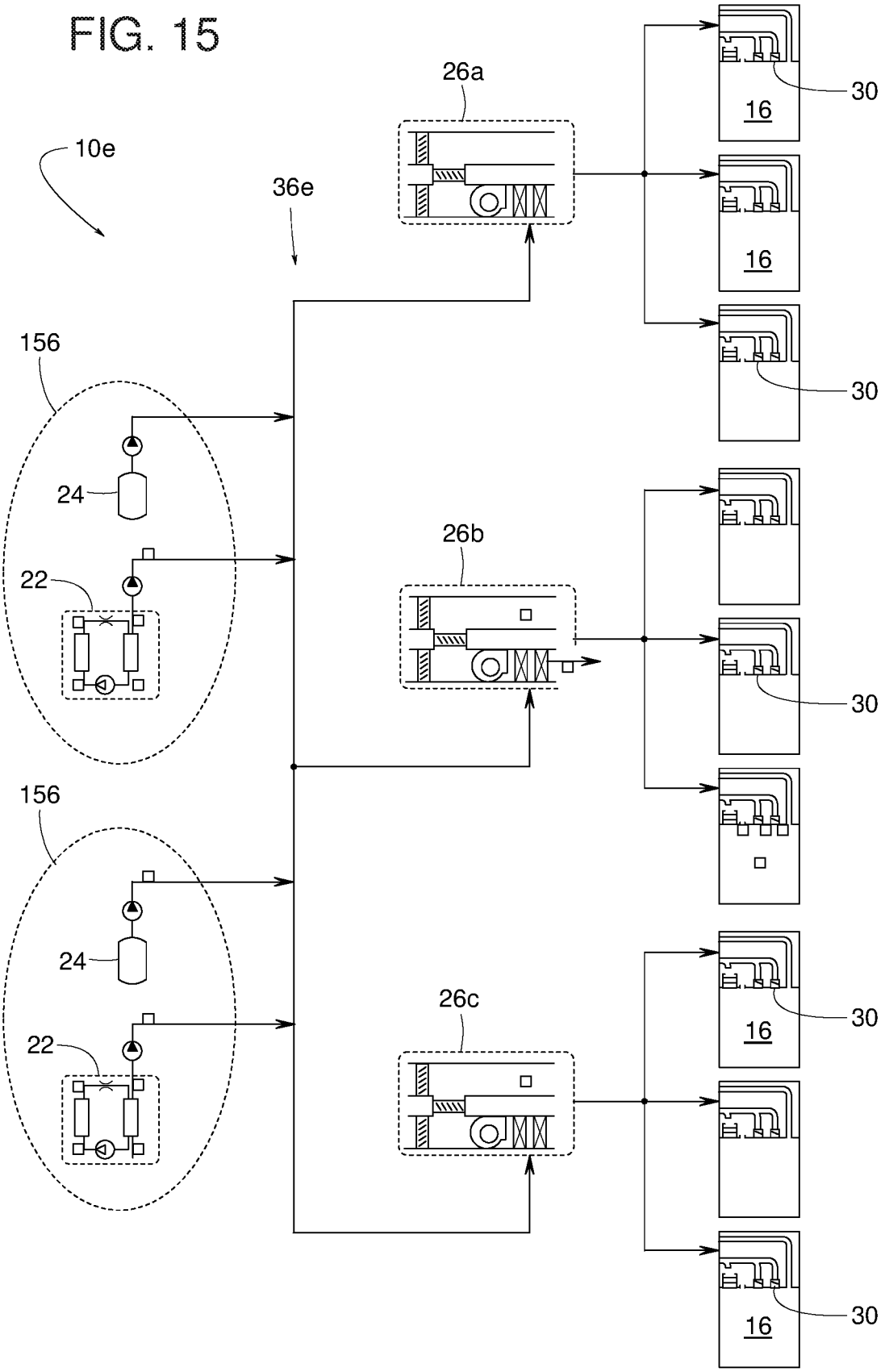
FIG. 15 is a schematic view of a fifth example HVAC system.

FIG. 14 shows and an example of how boiler 24 and chiller 22 can be configured in a fluid flow network 36*d* to serve three or more sets of FCU 28 and VAV valves 30 for heating or cooling three or more comfort zones 16. And FIG. 15 is a schematic diagram showing an example of how multiple boiler/chiller systems 156 and multiple AHUs 26 (e.g., AHU 26*a*, AHU 26*b*, AHU 26*c* and AHU 26*d*) can be configured in a fluid flow network 36*e* to heat or cool any number of comfort zones 16. In some examples, an individual comfort zone 16 can be conditioned selectively by different combinations of chillers 22 and boilers 24 and/or be conditioned selectively by different AHUs 26.

In the examples of FIGS. 14 and 15, controller 14 references HVAC models (e.g. in a format similar to those shown in FIGS. 7, 8, 10, 11 and 13) to help identify a fault at an HVAC device that is farthest upstream along a supply line shared by multiple HVAC devices experiencing faults.

Similar to the previously described examples, controller 14 then provides an indicator 146 directing operator 144 to a likely root cause problem.

Figure 16:
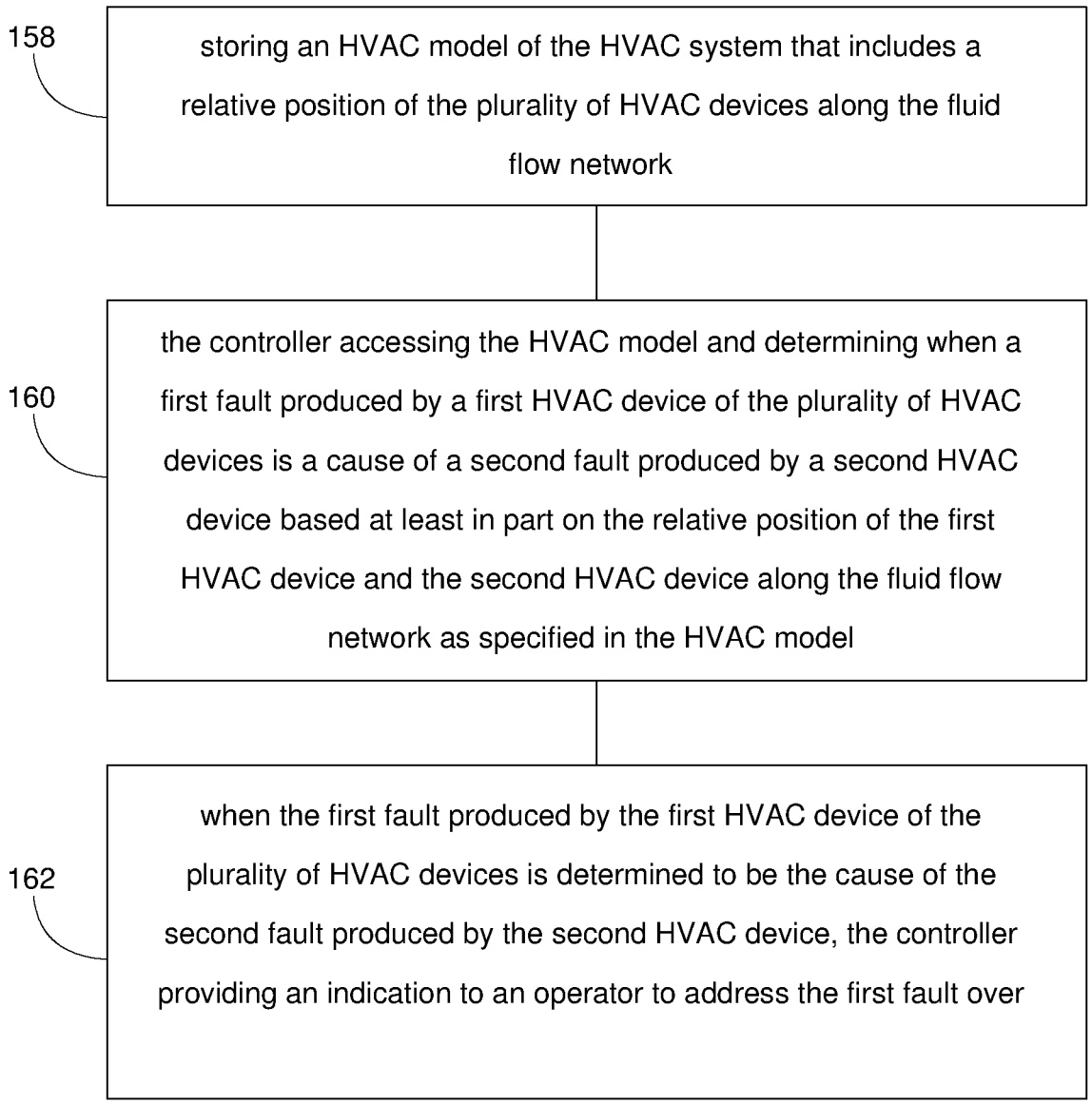
FIG. 16 is a block diagram illustrating an example method for processing faults generated in an HVAC system.

FIG. 16 is a block diagram illustrating one example method for processing faults 46 generated in an HVAC system 10 (e.g., HVAC systems 10*a-e*), wherein HVAC system 10 includes a plurality of HVAC devices 12 positioned along fluid flow network 36, wherein each of at least some of the plurality of HVAC devices 12 produce faults 46 (e.g., faults 46*a*, 46*b*, 46*c*, 46*d*, etc.) under one or more fault conditions and provide faults 46 to controller 14.

In this example method, a block 158 represents storing an HVAC model 20 of HVAC system 10 that includes a relative position of the plurality of HVAC devices 12 along fluid flow network 36.

A block 160 represents controller 14 accessing HVAC model 20 and determining when a first fault 46*a* produced by a first HVAC device 12*a* of the plurality of HVAC devices 12 is a cause of a second fault 46*b* produced by a second HVAC device 12*b* based at least in part on the relative position of the first HVAC device 12*a* and the second HVAC device 12*b* along fluid flow network 36 as specified in HVAC model 20.

A block 162 represents when first fault 46*a* produced by first HVAC device 12*a* of the plurality of HVAC devices 12 is determined to be the cause of second fault 46*b* produced by second HVAC device 12*b*, controller 14 provides an indication 146 to an operator 144 to address first fault 46*a* over second fault 46*b*. In some cases, the indication provided by the controller to the operator includes the first fault 46*a* but not the second fault 46*b*.

Figure 17:
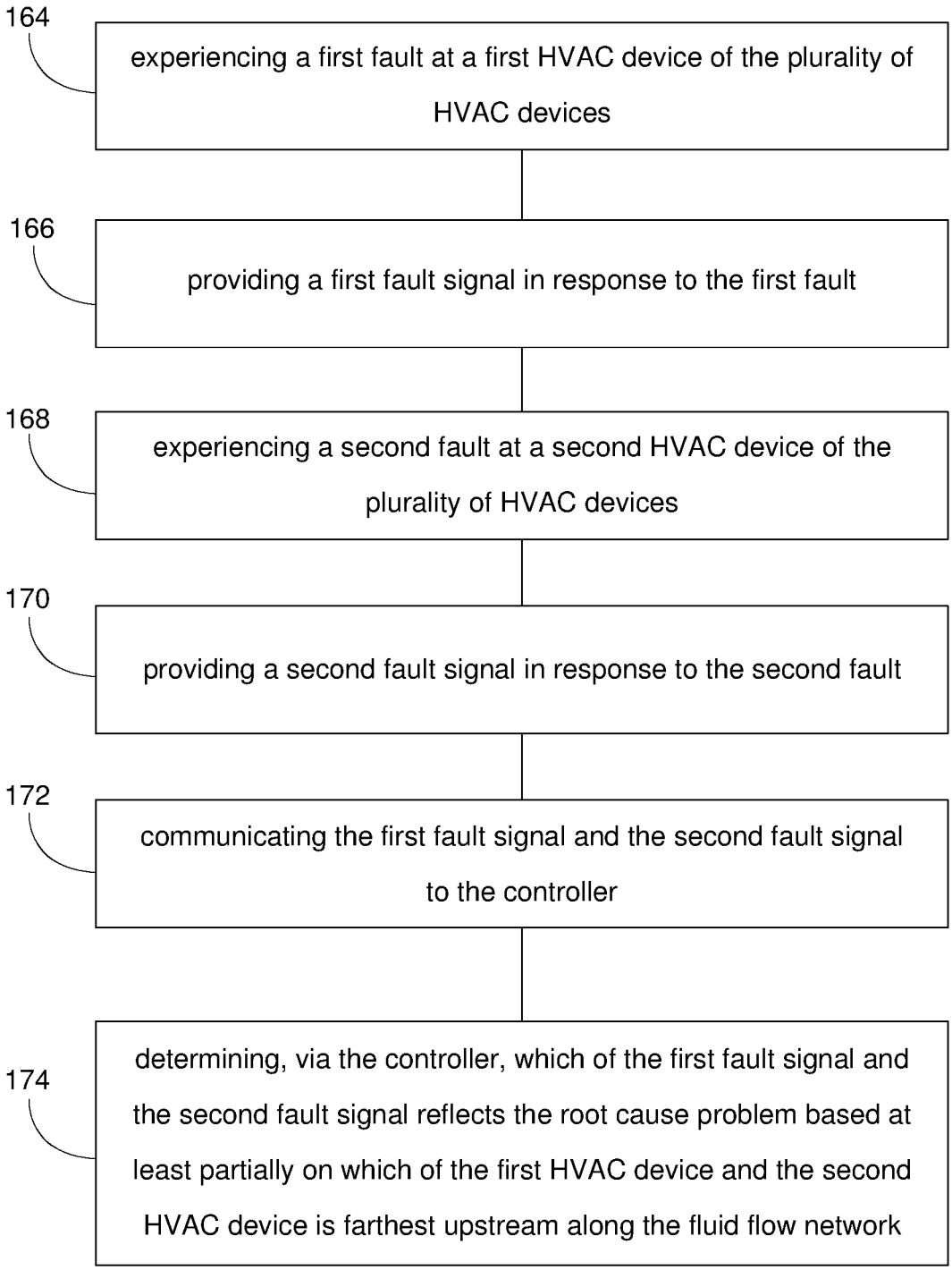
FIG. 17 is a block diagram illustrating an example method of using a controller for determining which fault signal of a plurality of fault signals identifies a root cause problem of an HVAC system.

FIG. 17 is a block diagram illustrating another method for using controller 14 in determining which fault signal 44' of a plurality of fault signals 44' identifies a root cause problem of HVAC system 10 that includes a plurality of HVAC devices 12 that are in thermodynamic communication with each other via fluid flow network 36.

In this example method, a block 164 represents experiencing a first fault 46*a* at a first HVAC device 12*a* of the plurality of HVAC devices 12.

A block 166 represents providing a first fault signal 44*a*' in response to first fault 46*a*.

A block 168 represents experiencing a second fault 46*b* at a second HVAC device 12*b* of the plurality of HVAC devices 12.

A block 170 represents providing a second fault signal 44*b*' in response to the second fault 46*b*.

A block 172 represents communicating first fault signal 44*a*' and second fault signal 44*b*' to controller 14.

A block 174 represents determining, via controller 14, which of the first fault signal 44*a*' and the second fault signal 44*b*' reflects the root cause problem based at least partially on which of the first HVAC device 12*a* and the second HVAC device 12*b* is farthest upstream along fluid flow network 36.

In some examples, the term, "fluid system" refers to at least one flowing fluid. Some examples of a fluid system include air flowing through an airduct, air flowing through a comfort zone, water flowing through a pipe, refrigerant flowing through a tube, water flowing through the inside of a heat exchanger tube while air flows across the exterior of the tube, and various combinations thereof. The term, "fluid" refers to any gas or liquid (e.g., air, water, glycol, steam, refrigerant, etc.).

In some examples, the terms "upstream" and "downstream" refer to the relative static pressure of two points of a fluid stream flowing along a generally continuous fluid path, wherein a point at a higher static pressure is upstream of a point at a lower static pressure, and a point at a lower static pressure is downstream of a point at a higher static pressure.

In some example fluid paths conveying a circulating fluid stream driven by a pump, a blower, or a compressor: the uppermost upstream point is at the discharge outlet of the pump, blower, or compressor; and the lowermost downstream point is at the suction inlet of the pump, blower, or compressor.

In some example segmented fluid paths including a supply path, a tributary path, and a heat exchanger connecting a first fluid in the supply path in heat exchange relationship with a second fluid in the tributary path, every point in the supply path is considered upstream of every point in the tributary path regardless of the actual static pressures of the supply and tributary paths. In an HVAC system having a segmented fluid path, the supply path is at or near the source of heating or cooling (e.g., at the boiler or chiller), and the tributary path is at or near the receiving end of the heating or cooling (e.g., at the comfort zone).

In some example segmented fluid paths including a supply branch, a second branch, and a heat exchanger connecting a first fluid in the supply branch in heat exchange relationship with a second fluid in the second branch, every point in the supply branch is considered upstream of every point in the second branch regardless of the actual static pressures of the two branches. In some example HVAC systems having a segmented fluid path, the supply branch is at or near the source of heating or cooling (e.g., at the boiler or chiller), and the second branch is at or near the receiving end of the heating or cooling (e.g., at the comfort zone).

The term, "root cause problem" refers to a system malfunction that leads to a sensed variable of the system going beyond (e.g. higher or lower) a predetermined acceptable range or threshold. Some examples of such a sensed variable include a temperature of a fluid, a pressure of a fluid, a flow rate of a fluid, an efficiency of an apparatus or process, a position of a valve, an electrical current to a motor, etc. A root cause problem is where a malfunction originates rather than the consequence of another problem.

The term, "fault" refers to a sensed variable of the system going beyond a predetermined acceptable range or threshold, wherein the fault is not necessarily a root cause problem. The terms, "first fault" and "second fault" are simply nondescript names to distinguish one fault from another. The terms, "first fault" and "second fault" do not suggest one fault necessarily occurs before the other.

Other Examples

In some cases, an illustrative system may include an HVAC system and a controller, wherein the HVAC system includes a plurality of HVAC devices positioned along a fluid flow network, wherein each of at least some of the plurality of HVAC devices produce faults under one or more fault conditions and provide the faults to the controller. An illustrative method may include: storing an HVAC model of the HVAC system that includes a relative position of the plurality of HVAC devices along the fluid flow network: the controller accessing the HVAC model and determining when a first fault produced by a first HVAC device of the plurality of HVAC devices is a cause of a second fault produced by a second HVAC device based at least in part on the relative position of the first HVAC device and the second HVAC device along the fluid flow network as specified in the HVAC model; and when the first fault produced by the first HVAC device of the plurality of HVAC devices is determined to be the cause of the second fault produced by the second HVAC device, the controller providing an indication to an operator to address the first fault over the second fault.

In some cases, the relative position of the plurality of HVAC devices may include a relative upstream/downstream position along the fluid flow network. In some cases, the fluid flow network may include two or more branches, with a first set of the plurality of HVAC devices in a first branch and a second set of the plurality of HVAC devices in a second branch, wherein the relative position of the first set of HVAC devices includes a relative upstream/downstream position along the first branch of the fluid flow network and wherein the relative position of the second set of HVAC devices includes a relative upstream/downstream position along the second branch of the fluid flow network.

In some cases, when the first fault produced by the first HVAC device of the plurality of HVAC devices is determined to be the cause of the second fault produced by the second HVAC device, the controller groups the first fault and the second fault into a group. In some cases, the indication to the operator to address the first fault over the second fault includes identifying the group with the first fault emphasized.

In some cases, the indication to the operator identifies the first HVAC device as the root cause for diagnosis.

Another illustrative method for determining which fault signal of a plurality of fault signals identifies a root cause problem of an HVAC system that includes a plurality of HVAC devices that are in thermodynamic communication with each other via a fluid flow network includes: experiencing a first fault at a first HVAC device of the plurality of HVAC devices: providing a first fault signal in response to the first fault: experiencing a second fault at a second HVAC device of the plurality of HVAC devices: providing a second fault signal in response to the second fault: communicating the first fault signal and the second fault signal to a controller; and determining, via the controller, which of the first fault signal and the second fault signal reflects the root cause problem based at least partially on which of the first HVAC device and the second HVAC device is farthest upstream along the fluid flow network.

An illustrative system may include an HVAC system and a controller, wherein the HVAC system may include a plurality of HVAC devices including at least a first HVAC device and a second HVAC device, a fluid flow network connecting the plurality of HVAC devices in thermodynamic communication with each other, the fluid flow network being configured to convey a fluid system in a downstream direction through the first HVAC device and the second HVAC device, and a plurality of sensors to provide a plurality of fault signals in response to the plurality of HVAC devices producing a plurality of faults. The plurality of sensors may include at least a first sensor associated with the first HVAC device and a second sensor associated with the second HVAC device. The plurality of fault signals may include at least a first fault signal from the first sensor and a second fault signal from the second sensor. The plurality of faults may include at least a first fault produced by first HVAC device and a second fault produced by the second HVAC device. The controller may receive the plurality of fault signals, and determine which of the plurality of fault signals identifies a root cause problem of the HVAC system based at least partially on which of the plurality of HVAC devices is farthest upstream along the fluid flow network, where both the first fault and the second fault stem from the root cause problem.

In some cases, the controller may determine which of the plurality of fault signals identifies the root cause problem of the HVAC system based further on whether the plurality of faults occur within a certain period of each other. In some cases, the controller displays each of the plurality of fault signals in addition to determining which of the plurality of fault signals identifies the root cause problem.

In some cases, where the fluid system includes a first fluid and a second fluid, and where the fluid flow network includes a first circuit conveying the first fluid, a second circuit conveying the second fluid, and a heat exchanger connecting the first fluid and the second fluid in heat transfer relationship with each other, the first circuit in its entirety may be considered upstream of the second circuit. In some cases, the first fluid and the second fluid are physically isolated from each other to prevent intermixing.

In some cases, the plurality of HVAC devices may include a plurality of variable air volume valves. In some cases, the plurality of HVAC devices may include a chiller, an air handling unit, and a VAV valve. In some cases, the fluid flow network may include at least one of a conduit and a comfort zone of a building. In some cases, the fluid system includes a gas and/or a liquid.

In some cases, at least one of the first fault and the second fault indicates that at least a portion of the fluid system is beyond a predetermined acceptable range of flow rate and/or beyond a predetermined acceptable range of temperature. These are just some examples.

An some instances, an illustrative HVAC system may include a plurality of HVAC devices including at least a first HVAC device and a second HVAC device, a fluid system including a first fluid and a second fluid, a fluid flow network connecting the plurality of HVAC devices in thermodynamic communication with each other, where the fluid flow network includes a first flow circuit conveying the first fluid downstream through the first HVAC device, a second flow circuit conveying the second fluid downstream through the second HVAC device, and a heat exchanger connecting the first fluid and the second fluid in heat transfer relationship with each other, the second flow circuit in its entirety being considered downstream of the first flow circuit.

The illustrative HVAC system may further include a plurality of sensors to provide a plurality of fault signals in response to the plurality of HVAC devices producing a plurality of faults. The plurality of sensors may include at least a first sensor associated with the first HVAC device and a second sensor associated with the second HVAC device. In some cases, the plurality of faults may include at least a first fault produced by first HVAC device and a second fault produced by the second HVAC device. A controller may be configured to determine which of the plurality of fault signals identifies a root cause problem of the HVAC system based on which of the plurality of HVAC devices is farthest upstream along the fluid flow network and further based on whether the plurality of faults occur within a certain period of time of each other, wherein both the first fault and the second fault stem from the root cause problem.

In some cases, the controller may display each of the plurality of fault signals in addition to determining which of the plurality of fault signals identifies the root cause problem.

In some cases, the first fluid and the second fluid are physically isolated from each other to prevent intermixing.

In some cases, the plurality of devices include one or more of a chiller, an air handling unit, and a VAV valve.

The disclosure should not be considered limited to the particular examples described above. Various modifications, equivalent processes, as well as numerous structures to which the disclosure can be applicable will be readily apparent to those of skill in the art upon review of the instant specification.

What is claimed is:

1. A method for processing faults generated in an HVAC system, wherein the HVAC system includes a plurality of HVAC devices each positioned along a corresponding one of a plurality of flow paths of a fluid flow network, wherein some of the plurality of HVAC devices produce faults under one or more fault conditions and provide the faults to a controller, the method comprising:

storing an HVAC model of the HVAC system that includes a relative position of each of the plurality of HVAC devices along the corresponding one of the plurality of flow paths of the fluid flow network;

the controller receiving faults produced by the plurality of HVAC devices, each fault is paired with a tuple that identifies:

a HVAC device of the plurality of HVAC devices that is associated with a respective fault;

a flow path of the plurality of flow paths that is associated with the respective fault;

a timestamp of when the respective fault occurred;

the controller automatically grouping the faults into a plurality of fault groups based at least in part on the tuples that are paired with the received faults, wherein each fault group corresponds to a corresponding flow path of the plurality of flow paths of the fluid flow network and each fault group includes only those faults that are produced by HVAC devices that are positioned along the flow path that corresponds to the fault group and occurred within a predetermined period of time of each other;

the controller accessing the HVAC model and automatically determining when a first fault of a first fault group of the plurality of fault groups produced by a first HVAC device of the plurality of HVAC devices of the first fault group is a root cause of a second fault of the first fault group of the plurality of fault groups produced by a second HVAC device of the first fault group based at least in part on the relative position of the first HVAC device and the second HVAC device along the flow path that correspond to the first fault group as specified in the HVAC model; and when the first fault produced by the first HVAC device of the plurality of HVAC devices of the first fault group is determined to be the root cause of the second fault produced by the second HVAC device of the first fault group, the controller automatically notifying an operator that the first fault is the root cause of the second fault via a visual indication on a display.

2. The method of claim 1, wherein the relative position of the plurality of HVAC devices comprises a relative upstream/downstream position along the corresponding one of the plurality of flow paths of the fluid flow network.

3. The method of claim 2, wherein a first set of the plurality of HVAC devices are positioned along a first one of the plurality of flow paths and a second set of the plurality of HVAC devices are positioned along a second one of the plurality of flow paths, wherein the relative position of the first set of the plurality of HVAC devices comprises a relative upstream/downstream position along the first one of the plurality of flow paths of the fluid flow network and wherein the relative position of the second set of the plurality of HVAC devices comprises a relative upstream/downstream position along the second one of the plurality of flow paths of the fluid flow network.

4. The method of claim 1, wherein when the first fault produced by the first HVAC device of the first fault group is determined to be the root cause of the second fault produced by the second HVAC device of the first fault group, the controller automatically displaying the first fault to the operator while not concurrently displaying the second fault.

5. The method of claim 1, wherein when the first fault produced by the first HVAC device of the first fault group is determined to be the cause of the second fault produced by the second HVAC device of the first fault group, the controller concurrently displaying the first fault and the second fault on the display with the first fault emphasized.

6. A method for using a controller for determining which fault of a plurality of faults identifies a root cause problem of an HVAC system that includes a plurality of HVAC devices that are in thermodynamic communication with each other via a fluid flow network, the method comprising:

experiencing a first fault at a first HVAC device of the plurality of HVAC devices;

experiencing a second fault at a second HVAC device of the plurality of HVAC devices;

communicating the first fault and the second fault to the controller;

determining, via the controller, whether both the first HVAC device and the second HVAC device are positioned along a common flow path of the fluid flow network and whether the first fault and the second fault occurred within a predetermined period of time of each other; when the controller determines that the first HVAC device and the second HVAC device are positioned along a common flow path of the fluid flow network and that the first fault and the second fault occurred within a predetermined period of time of each other, the controller grouping the first fault and the second fault into a first fault group;

the controller automatically determining which of the first fault and the second fault of the first fault group reflects the root cause problem based at least partially on which of the first HVAC device and the second HVAC device is farthest upstream along the common flow path of the first fault group;

in response to determining which of the first fault and the second fault of the first fault group reflects the root cause problem, the controller automatically displaying the first fault and the second fault of the first fault group concurrently on a display, with the fault that is determined to reflect the root cause problem visually emphasized;

and wherein displaying the first fault and the second fault of the first fault group concurrently on a display further comprises displaying at least one of the first fault and the second fault paired with a tuple that identifies a HVAC device of the plurality of HVAC devices that is associated with a respective fault, a flow path of the plurality of flow paths that is associated with the respective fault, and a timestamp of when the respective fault occurred.

7. A system comprising:

an HVAC system including:

a) a plurality of HVAC devices including at least a first HVAC device and a second HVAC device;

b) a fluid flow network connecting the plurality of HVAC devices in thermodynamic communication with each other, the fluid flow network being configured to convey a fluid system in a downstream direction through the first HVAC device and the second HVAC device;

c) a plurality of sensors to provide a plurality of fault signals in response to the plurality of HVAC devices producing a plurality of faults;

d) the plurality of sensors including at least a first sensor associated with the first HVAC device and a second sensor associated with the second HVAC device;

e) the plurality of fault signals including at least a first fault signal from the first sensor and a second fault signal from the second sensor;

f) the plurality of faults including at least a first fault produced by the first HVAC device and a second fault produced by the second HVAC device each occurring corresponding time;

a controller operatively coupled to the HVAC system and configured to receive the plurality of fault signals, the controller configured to:

pair each fault with a tuple that identifies:

a HVAC device of the plurality of HVAC devices that is associated with a respective fault, a flow path of the plurality of flow paths that is associated with the respective fault, and a timestamp of when the respective fault occurred;

determine whether both the first HVAC device and the second HVAC device are positioned along a common flow path of the fluid flow network and whether the first fault signal and the second fault signal occur within a predetermined period of time of each other;

when the controller determines that the first HVAC device and the second HVAC device are positioned along a common flow path of the fluid flow network and that the first fault signal and the second fault signal occur within a predetermined period of time of each other, grouping the first fault signal and the second fault into a first fault group; and automatically determine which of the plurality of fault signals of the first fault group identifies a root cause problem of the HVAC system based at least partially on which of the plurality of HVAC devices associated with the first fault group is farthest upstream along the common flow path of the fluid flow network, wherein both the first fault signal and the second fault signal stem from the root cause problem.

8. The system of claim 7, wherein the controller automatically determines which of the plurality of fault signals of the first fault group identifies the root cause problem of the HVAC system based further on whether the plurality of faults occur within a certain period of each other.

9. The system of claim 7, wherein the controller automatically displays each of the plurality of fault signals of the first fault group in addition to visually indicating which of the plurality of fault signals of the first fault group identifies the root cause problem.

10. The system of claim 7, wherein the fluid system includes a first fluid and a second fluid, and wherein the fluid flow network includes a first circuit conveying the first fluid, a second circuit conveying the second fluid, and a heat exchanger connecting the first fluid and the second fluid in heat transfer relationship with each other, the first circuit in its entirety being considered upstream of the second circuit.

11. The system of claim 10, wherein the first fluid and the second fluid are physically isolated from each other to prevent intermixing.

12. The system of claim 7, wherein the plurality of HVAC devices include a plurality of variable air volume valves.

13. The system of claim 7, wherein the plurality of HVAC devices include a chiller, an air handling unit, and a VAV valve.

14. The system of claim 7, wherein the fluid flow network includes at least one of a conduit and a comfort zone of a building.

15. The system of claim 7, wherein the fluid system includes a gas.

16. The system of claim 15, wherein the gas is mostly air.

17. The system of claim 7, wherein the fluid system includes a liquid.

18. The system of claim 7, wherein at least one of the first fault and the second fault indicates that a flow rate in at least a portion of the fluid system has gone beyond a predetermined acceptable flow rate range.

19. The system of claim 7, wherein at least one of the first fault and the second fault indicated that a temperature in at least a portion of the fluid system has gone beyond a predetermined acceptable temperature range.

* * * * *